United States Patent [19]

Mendel

[11] Patent Number: 4,812,715

[45] Date of Patent: Mar. 14, 1989

[54] CURRENT-LEVEL TRIGGERED PLASMA-OPENING SWITCH

[75] Inventor: Clifford W. Mendel, Albuquerque, N. Mex.

[73] Assignee: The United States Department of Energy, Washington, D.C.

[21] Appl. No.: 67,027

[22] Filed: Jun. 29, 1987

[51] Int. Cl.[4] ..... H01J 17/00; H01J 1/50; H05B 37/00

[52] U.S. Cl. ..... 315/340; 315/39; 315/344; 315/290; 313/157; 313/161; 313/231.31

[58] Field of Search ..... 315/39, 111.21, 111.41, 315/340, 338, 344, 290; 376/108, 111; 250/396 R; 313/157, 161, 231.31

[56] References Cited

U.S. PATENT DOCUMENTS

| | | | |
|---|---|---|---|
| 4,596,945 | 6/1986 | Schumacher et al. | 315/344 |
| 4,721,891 | 1/1988 | Krausse | 315/340 |
| 4,727,298 | 2/1988 | Mendel | 315/340 |

OTHER PUBLICATIONS

Mendel et al., "A Fast Opening Switch For Use in REB Diode Experiments", J. Appl. Phys., vol. 48, No. 3, Mar. 1977, pp. 1004–1006.

Mendel et al., "Performance of a Plasma Filled, Series—Field—Coil Ion Beam Diode", J. Appl. Phys., vol. 53, No. 11, Nov. 1982, pp. 7265–7273.

Mendel et al., "Analytic Theory of Series Field Coil Ion Diodes", Physical Review A, vol. 27, No. 6, Jun. 1983, pp. 3258–3273.

Stringfield et al., "Plasma Erosion Switches with Imploding Plasma Loads on a Multiterawatt Pulsed Power Generator", J. Appl. Phys., 52(3), 3/1981, pp. 1278–1284.

*Primary Examiner*—David K. Moore
*Assistant Examiner*—Mark R. Powell
*Attorney, Agent, or Firm*—George H. Libman; James H. Chafin; Judson R. Hightower

[57] ABSTRACT

An opening switch for very high power electrical pulses uses a slow magnetic field to confine a plasma across a gap between two electrodes. The plasma conducts the electric pulse across the gap while the switch is closed. A magnetic field generated by the pulse repels the slow magnetic field from the negative electrode to push the plasma from the electrode, opening the switch. A plurality of radial vanes may be used to enhance the slow magnetic field.

10 Claims, 4 Drawing Sheets

CURRENT-LEVEL TRIGGERED PLASMA-OPENING SWITCH

The U.S. Government has rights in this invention pursuant to Contract No. DE-AC04-76DP00789 between the Department of Energy and AT&T Technologies, Inc.

This invention relates to a fast opening switch for very high power pulse applications, and more particularly to a self-triggered switch using a magnetic field to repel a conducting plasma trapped in a second magnetic field.

BACKGROUND OF THE INVENTION

Pulse power technology often needs very short, ultra-high power pulses. For example, certain light ion fusion experiments require pulses of 10–15 ns and $10^{13}$–$10^{14}$ W. These pulses could be attained with a fast opening switch of sufficient speed, current carrying capability and voltage hold-off capability, as power could be stored in inductors and released by the switch.

The first plasma-filled opening switch that could switch high power at a fast opening speed was reported by C. Mendel et al., "A fash-opening switch for use in REB diode experiments," Journal of Applied Physics, Vol. 48, No. 3, March 1977, page 1004. The switch uses an unconfined plasma to short out two spaced electrodes. When sufficient current flows through the switch, a sheath at the plasma-electrode interface begins to grow in thickness, increasing the impedance of the plasma gap. When this sheath is sufficiently thick, the diode current flows through the electrode rather than the plasma, and the switch is open. This plasma opening switch has been further developed since 1977, but it still has operational disadvantages such as difficulty in conducting currents for long times, strong dependence on the plasma parameters (making accurate timing difficult), and a reuqirement for high plasma densities for operation.

A triggered version of the switch, shown in applicant's copending application Ser. No. 884,858, filed July 14, 1986, now U.S. Pat. No. 4,727,298 overcomes the first two deficiencies listed above. However, this switch generally does use high plasma-fill densities and a trigger apparatus that may require space that is not readily available for some applications.

SUMMARY OF THE INVENTION

It is an object of this invention to provide a self-triggered plasma-opening switch requiring less plasma than the prior art.

It is another object of this invention to provide a self-triggered plasma-opening switch having less dependence on plasma parameters than the prior art.

It is also an object of this invention to provide a self-triggered plasma-opening switch using a magnetic field generated by the current pulse to repel a second magnetic field confining a shorting plasma.

Additional objects, advantages, and novel features of the invention will become apparent to those skilled in the art upon examination of the following description or may be learned by practice of the invention. The objects and advantages of the invention may be realized and attained by means of the instrumentalities and combinations particularly pointed out in the appended claims.

To achieve the foregoing and other objects, and in accordance with the purpose of the present invention, as embodied and broadly described herein, the present invention may comprise a coaxial transmission line formed of concentric metal electrodes extending between a high power pulse power source and a load. Slow coil means are provided for generating a slow magnetic field (relative to the rise time of the pulse) in the gap between the cylinders. Plasma generating means supply a plasma in the gap in the location of the slow field, the plasma being confined by the slow magnetic field. When the pulse power is applied, current is shunted through the plasma across the gap. After the switch current reaches a value determined by the magnitude of the slow magnetic field, this field is repelled from the electrode connected to the negative source terminal because the self-magnetic field due to electron flow exceeds the slow field, thereby opening the switch.

BRIEF DESCRIPTION OF THE DRAWINGS

The accompanying drawings, which are incorporated in and form part of the specification, illustrate an embodiment of the present invention and, together with the description, serve to explain the principles of the invention.

DETAILED DESCRIPTION OF THE INVENTION

Figure 1:
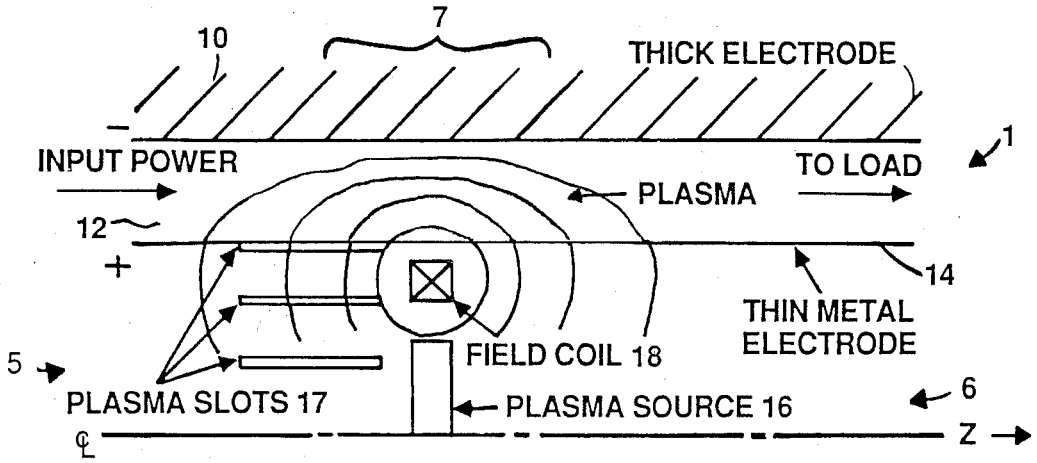
FIG. 1 shows a sectional schematic view of a first embodiment of the invention.

FIG. 1 shows a switch 1 including a pair of elongate concentric metal electrodes 10 and 14 for connection between a source (not shown) of a pulse of very high voltage and high current at input end 5 and a load (not shown) at output end 6. The switch portion 7 of switch 1 is in a closed state at the time the current pulse is initiated, shorting out the pulse and preventing it from reaching the load. After a delay on the order of tens to hundreds of nanoseconds, the switch opens, allowing a clean pulse to reach the load.

In accordance with a preferred embodiment of this invention, each of electrodes 10 and 14 may comprise a surface of revolution about a center line C along axis Z. A surface of revolution is defined by rotating a line extending from input end 5 to output end 6 about the center line. If the line is straight and parallel to axis Z, as in FIG. 1, the surface of revolution is a cylinder. However, any combination of line segments extending between ends 5 and 6 may be rotated about the center line to form the surface of revolution of this invention. Regardless of the line, any cross-section through the resulting structure perpendicular to axis Z is a circle.

It should be understood that other electrode geometries may be used with this invention. For example, each of the input and output ends may be a transmission line of any type that will transmit a pulse of the type used with this invention. The switching portion may also have any desired cross-section, although it is preferrable that the gap between electrodes 10 and 14 be constant around the gap circumference in every plane perpendicular dicular to axis Z, to ensure an even distribution of power. Of course, this condition is met when each of the electrodes is a surface of revolution. It also could be met if each electrode has an elliptical cross-section, for example.

As shown in FIG. 1, switch 1 also includes a switch portion 7 between ends 5 and 6. In order for switching of current to occur at portion 7, switch 1 further includes a plasma source 16 for providing an electrically conducting plasma in gap 12 between the inner surface of outer electrode 10 and the outer surafce of inner conductor 14. In the disclosed embodiment, plasma source 16 is shown to be placed within inner electrode 14, and slots 17 are provided in the surface of electrode 14 for the plasma to reach gap 12.

Plasma source 16 may conventionally be a flashboard, a printed circuit board having a plurality of copper conductive paths deposited thereon, each path including a plurality of graphite-filled gaps. When a charged capacitor is discharged across each path, the resulting series of graphite arcs produce a plasma that is JXB accelerated away from the board by the discharge current. Additional information on flashboard plasma sources is discussed in Sandia Report SAND86-0015, "Particle Beam Fusion Progress Report, January 1985 Through June 1985," June 1986, pages 100–103.

If this structure were to be used in accordance with the teachings of the aforementioned 1977 Mendel et al. article, additional means would be needed to confine the plasma to the switch region 7. Otherwise, plasma would disperse in gap 12 and be unable to support the current flow unless source 16 could provide copious amounts of plasma. Furthermore, exact timing of the switching would be very difficult as the time of switching is dependent on the amount of plasma present at the time the power source was fired.

In accordance with this invention, slow field coil 18 is provided to generate a magnetic field to confine and guide the plasma generated by source 16. As shown, coil 18 is coaxial with switch 1 and located inside electrode 14. Coil 18 is energized for a relatively long period (such as 100 microseconds) compared to the pulse length of the high current pulse (on the order of 50 nanoseconds). Inner electrode 14 is made of relatively thin and relatively low conductivity nonmagnetic metal, such as stainless steel, to permit the magnetic field to pass through electrode 14 to gap 12. Electrode 10 is made of relatively thick and high conductivity metal to prevent the magnetic field from coil 18 from penetrating.

Figure 2A:
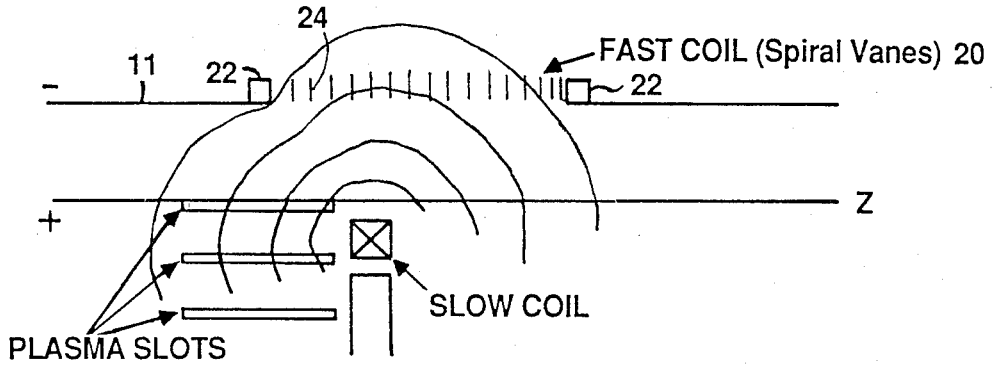
FIG. 2*a* show a sectional schematic view of a second embodiment of the invention while the switch is closed.
Figure 2B:
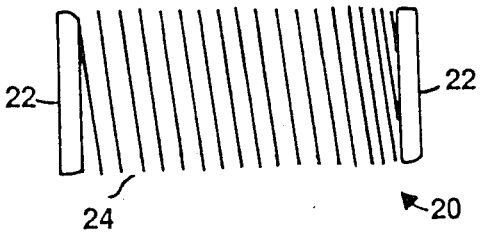
FIG. 2*b* shows the fast coil of the second embodiment of the invention.
Figure 2C:
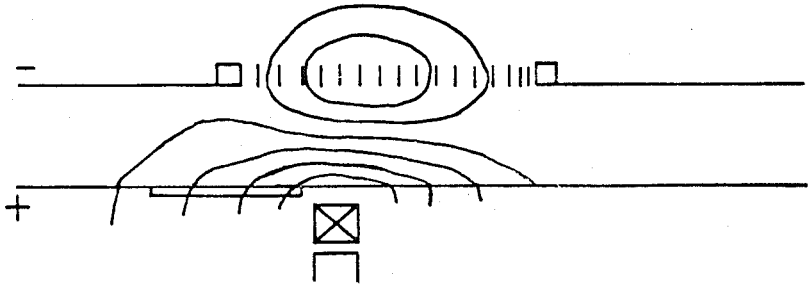
FIG. 2*c* shows a sectional schematic view of the second embodiment after the switch has opened.

In operation, coil 18 is energized to create a slow magnetic field with lines of force extending within gap 12 at switch portion 7 as shown in FIGS. 1, **2*b*, and 2*c*. After the slow magnetic field reaches full strength, plasma source 16 is excited to generate a plasma in gap 12. The magnetic field confines the plasma from source 16 because of the highly conductive nature of the plasma. When the input pulse is applied across end 5 of switch 1, electrons flow through conductor 10 to the confined plasma at switch portion 7, along the edge of the plasma across gap 12 (the current cannot penetrate the highly conductive plasma more than a few millimeters), and back to the power source through conductor 14. When the magnetic pressure, or force, due to the current flow in conductor 10 exceeds the magnetic force of the slow field, this latter field is forced away from conductor 10. Since the slow magnetic field also confined the plasma across gap 12, movement of the magnetic field away from conductor 10 also moves the conducting plasma away from conductor 10, thereby breaking the conduction path and directing current from the source through the load, as shown in FIGS. 1 and 2*c***.

The advantage of this invention over the prior art version without magnetic confinement of plasma is that the switch operation of the invention is relatively independent of the amount of plasma in the gap (a different parameter to accurately control) and dependent on the magnetic fields of the slow field coil 18 and the applied high power pulse (easier parameters to control).

FIGS. **2*a*, 2*b*, and 2*c* show a schematic representation of a second embodiment where the electrode carrying electrons from the source has been modified to increase the magnetic field used to repel the slow magnetic field from coil 18. Reference numerals in these figures are unchanged when they refer to components shown in FIG. 1**.

The embodiment of FIG. **2*b* is similar to the embodiment of FIG. 1 from electrode 14 radially inwardly. However, the switch portion 7 of electrode 10, the electrode from which the slow magnetic field is pushed back, defines a series fast coil 20 formed of a plurality of parallel, spaced, electrically conducting, conductors such as vanes 24 extending helically around the electrode. As shown in FIG. 2*b*, the slow magnetic field can penetrate the gaps between vanes 24; however, the plasma is still confined by this magnetic field. A relatively thick, highly conductive, ring 22 may help to prevent the slow magnetic field from penetrating portion 11 of coil 20**.

The switch is closed, as shown in FIG. **2*a*, when the pulse is first applied. Current from the source moves along electrode 11 to the plasma, along the edge of the plasma to electrode 14, and back to the source. This current moves axially along the switch, generating an azimuthal ($B_O$) fast magnetic field, as in the embodiment of FIG. 1, to push the plasma away from electrode 11, permitting the current to flow towards the load through coil 20. By providing a number of parallel paths, each path longer than the distance across switch portion 7, the inductance of electrode 20 at switch portion 7** is increased. These parallel paths provide an additional axial ($B_z$) magnetic field to more quickly open the switch.

FIG. **2*c* shows this second embodiment of the invention after the switch has opened. A magnetic field generated by the current passing through the vanes has pushed the plasma confined by the slow magnetic field away from electrode 20, causing the current to pass through vanes 24** to the load.

Figure 3:
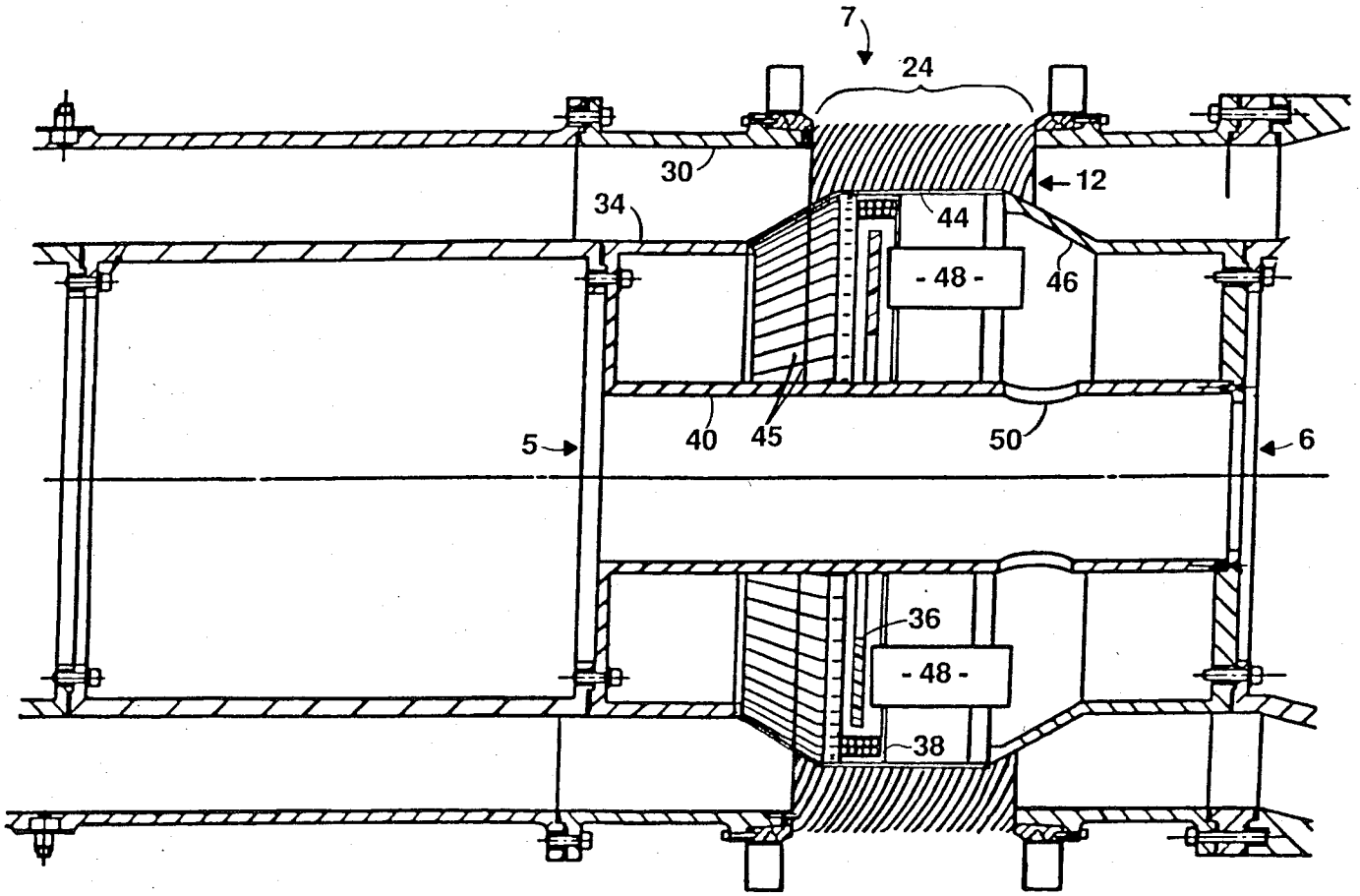
FIG. 3 shows a sectional view of one version of the second embodiment.

A first embodiment of the invention using the coil of FIGS. **2*a*–*c* is shown in FIG. 3 to include an inner electrode 34 and a concentric outer electrode 30. An input end 5 the electrodes are connectable through metal tubing as is conventional in this art (typically, aluminum) to a power source such as SuperMITE, a Sandia Laboratories generator capable of providing an output of 3 megavolts and 1 megampere for 40 nanoseconds. A load is connectable to output end 6**.

Switch portion 7 of cylindrical outer electrode 30 is formed of 45 parallel, spaced, vanes 24; each vane making one quarter revolution of the circumference of electrode 30 between the input and output ends of switch portion 7. These vanes generate a magnetic field along the axis, $B_z=2.4*B_O$ for this embodiment, where $B_O$ is the azimuthal field generated by current passing through the electrodes parallel to the Z axis and $B_z$ is the field parallel to the Z axis generated by current passing azimuthally to the Z axis through vanes 24. The increased magnitude of magnetic field of the $B_z$ component ensures that the plasma and slow magnetic field is repelled without requiring additional current flow through the electrodes.

The surface of inner conductor 34 at switch portion 7 forms a noncylindrical surface of revolution including a thin stainless steel cylinder 44 approximately 10 cm (4") long spaced approximately 2.5 cm (1") across gap 12 from vanes 24. The diameter of outer conductor 30, and vanes 24, is approximately 36 cm (14"). Cylinder 44 is connected to the output end of electrode 34 by a conical connecting piece 46. Cylinder 44 is connected to the input end of electrode 34 by a plurality of spaced wires 45, two of which wires are labeled in FIG. 3. Slow field coil 38 is mounted concentrically with and inside electrode 44, and produces a magnetic field on the order of 0.7 Tesla. Plasma source 36 is a flashboard formed as a disk mounted inside and concentric with coil 38 and around inner tube 40, the disk having eight copper conductive paths, each path including a plurality of gaps filled with graphite. Eight capacitors 48 are spaced around the disk of plasma source 36 and connected as the power source for the eight conductive paths as is well known in the art. Power for coil 38 and capacitor 48 comes from wires (not shown) passed through the interior of electrode 34 and through opening 50 in tube 40.

Figure 4:
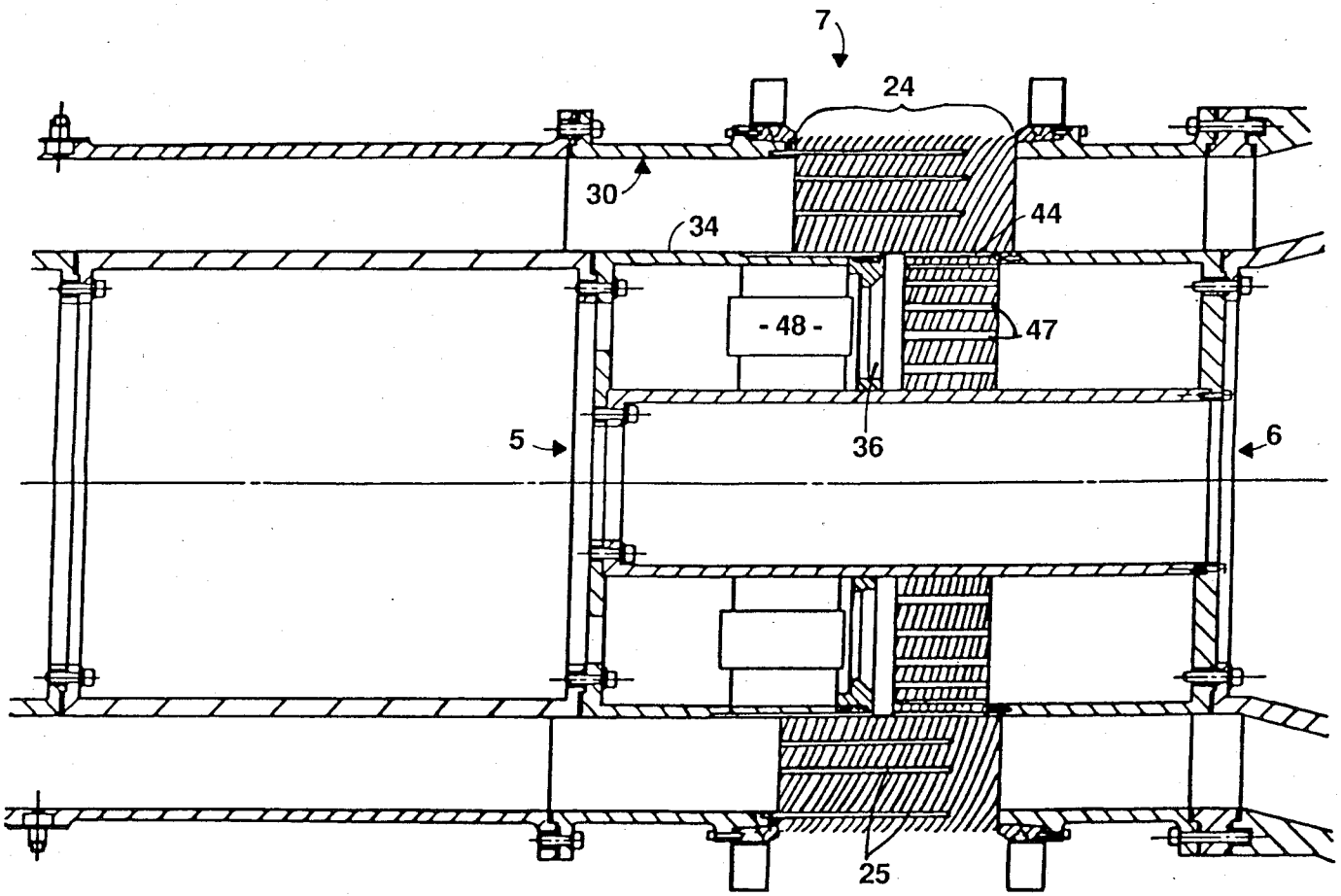
FIG. 4 shows a sectional view of a second version of the second embodiment.

FIG. 4 shows a preferred embodiment of the invention to include a plurality of azimuthally spaced rods 25 (two of which rods are labeled) in outer conductor 30 extending axially from the input end of switch portion 7, just under coil 24, across approximately 75% of the switch portion. These rods may conveniently be formed of piano wire and have a thin paddle (not shown) approximately 1 cm wide fastened to the free end thereof. In addition, switch inner conductor 44 has the same diameter as the remainder of inner conductor 34, and the wires 45 of FIG. 3 have been replaced by rigid metal struts 47 (two of which struts are labeled) having openings therebetween for the plasma at the output side of the switch. Experiments have shown these changes to cause the current from the switch closing to be more evenly distributed along the length of switch 7, thereby minimizing pitting and other damage that occurred in the embodiment of FIG. 3.

Figure 5:
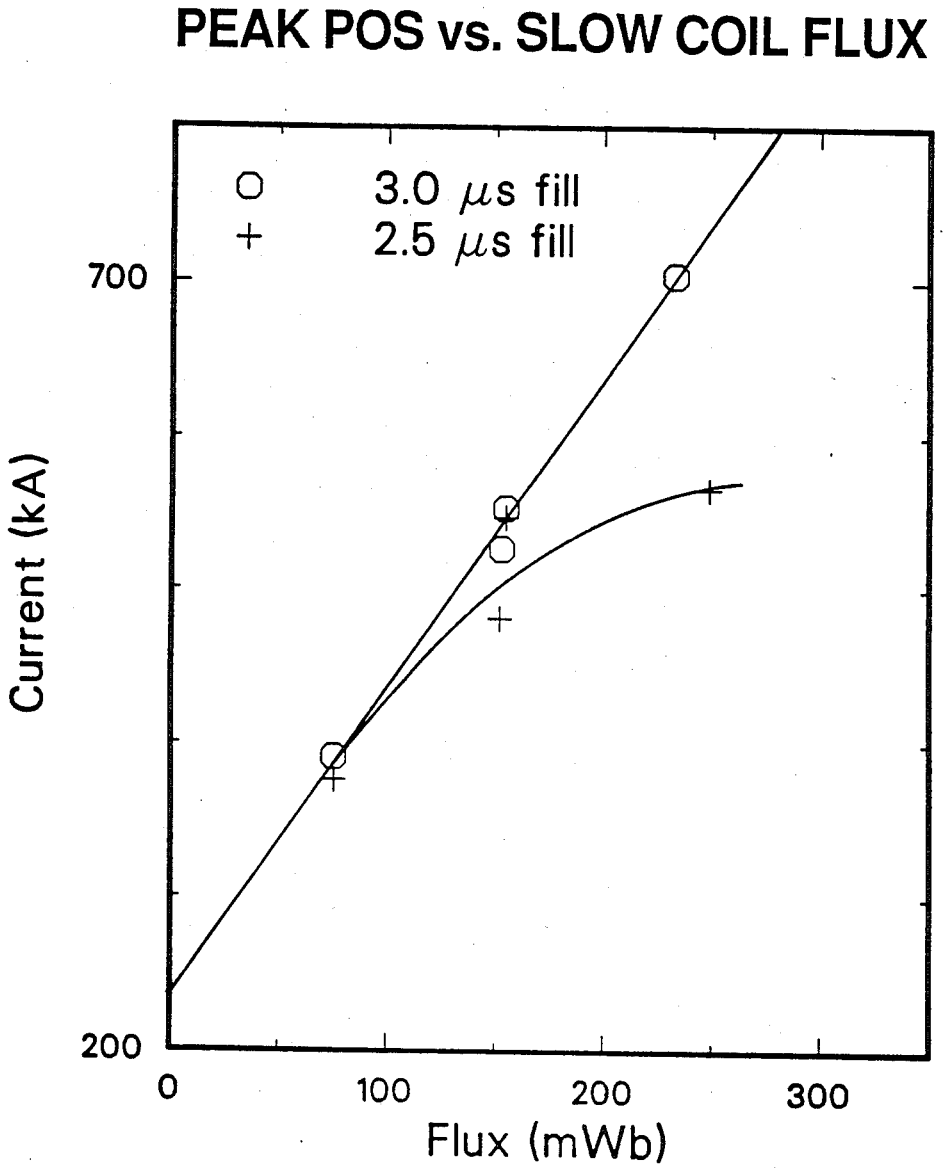
FIG. 5 is a graph showing test results from the invention.

The peak plasma opening switch current (POS) is approximately equal to the opening current. FIG. 5 shows the peak POS currents for tests at several values of slow coil flux for two different plasma fill times. At the longer fill time, indicative of more plasma in the switch, the peak current is linear with respect to slow coil flux. It does not have a zero intercept due to the properties of the electron flow in the switch. At the shorter fill time, with less plasma in the switch, the peak current saturates due to the depletion of the plasma in the switch. In other words, the switch was being asked to carry too much charge for the amount of plasma. The 3.0 us fill curve would also saturate at sufficiently high slow coil flux.

Although the disclosed embodiments show the slow field coil being mounted within inner electrode 34, this construction is not critical. The thin electrode could be mounted outside of the electrode that generates the fast magnetic field, and the slow field coil could surround the outer electrode. Vanes, if present, would be on the inner electrode. What is critical is that the slow field coil be mounted on the side opposite the gap of the thin electrode. Preferably, the slow field coil is on the side of the gap opposite the electrode connected to the negative terminal of the source, as this structure ensures that the current path is broken where electrons (from the negative terminal) leave the electrode; and that the sheath effect used in the prior art switch is also available to help the magnetic field open the switch. In addition, the plasma source could be mounted in the gap and the slots in the thin electrode eliminated.

The particular sizes and equipment discussed above are cited merely to illustrate a particular embodiment of this invention. It is contemplated that the use of the invention may involve components having different sizes and shapes as long as the principle, using a slow magnetic field instead of the inertia of a plasma to hold the switch closed, is followed. It is intended that the scope of the invention be defined by the claims appended hereto.

I claim:

1. A current-level-triggered plasma-opening switch for connecting a very high current, high voltage, power supply for generating current pulses at an input end to a load at an output end, said switch comprising:

a coaxial transmission line consisting of:

a first metal electrode; and a second metal electrode coaxial with and spaced by a gap from said first electrode, wherein current from said source flows into one electrode and out of the other electrode; said transmission line having a switch portion located between said ends, said switch portion including:

slow coil means coaxial with said transmission line for generating a slow magnetic field extending across said gap in said switch portion between said electrodes, said first metal electrode including means for preventing the penetration of said slow magnetic field into said electrode during the operation of the slow coil means, and means for generating a plasma in said gap in the location of said slow magnetic field; whereby said plasma is confined by said slow magnetic field between, and provides an electrically conductive path between, said electrodes, thereby shunting the current across the gap; and said slow magnetic field and said conductive plasma are forced from said first electrode when the self-magnetic field generated by current flow exceeds said slow magnetic field, thereby opening the switch.

2. The switch of claim 1 wherein said first and second electrodes each define a surface of revolution, said second electrode being inside said first electrode.

3. The switch of claim 2 wherein said slow coil means is inside said second electrode, the thickness of said second electrode adjacent said gap being thin enough to permit the slow magnetic field to penetrate said electrode.

4. The switch of claim 3 wherein said means for generating a plasma is located inside said second electrode near said slow coil.

5. The switch of claim 4 wherein said surface of said second electrode adjacent said slow coil has an opening between the inside of said second electrode and the gap.

6. The switch of claim 5 wherein said surface of said second electrode at the input end of said switch portion consists of a plurality of spaced, parallel, conductors, the area between said conductors defining the opening in said second electrode.

7. The switch of claim 2 wherein the thickness of said first electrode in said switch portion is sufficient to prevent said slow magnetic field from penetrating said electrode.

8. The switch of claim 2 wherein the switch portion of said first electrode is cylindrical and defines a series field coil consisting of a plurality of parallel, spaced, metal vanes extending helically around said electrode, the fast magnetic field generated by electrons from said supply flowing through said coil serving to hold said slow magnetic field from said first electrode.

9. The switch of claim 8 wherein said means for preventing penetration of said slow magnetic field comprises a ring coaxial with said electrode of sufficient thickness to prevent the slow magnetic field from penetrating said electrode, one end of each of said vanes being connected to said ring.

10. The switch of claim 3 further comprising means for energizing said slow coil to full current in about 100 microseconds, said power supply having a rise time of about 50 nanoseconds.

* * * * *